US009862015B1

(12) United States Patent
Lin

(10) Patent No.: US 9,862,015 B1
(45) Date of Patent: Jan. 9, 2018

(54) PIPE STRAIGHTENER

(71) Applicant: Jia-Rong Lin, Taichung (TW)

(72) Inventor: Jia-Rong Lin, Taichung (TW)

( * ) Notice: Subject to any disclaimer, the term of this patent is extended or adjusted under 35 U.S.C. 154(b) by 0 days.

(21) Appl. No.: 15/257,932

(22) Filed: Sep. 7, 2016

(51) Int. Cl.
*B21D 3/06* (2006.01)

(52) U.S. Cl.
CPC ..... *B21D 3/06* (2013.01)

(58) Field of Classification Search
CPC . B21D 3/00; B21D 3/04; B21D 3/045; B21D 3/05; B21D 3/06; B21D 3/08; B21B 17/14; B21F 1/02; B21F 1/023; B21C 1/16; B21C 1/18; B21C 19/00; B21C 37/30
See application file for complete search history.

(56) References Cited

U.S. PATENT DOCUMENTS 3,100,519 A * 8/1963 Johnston ..... B21F 1/02 72/78
3,672,197 A * 6/1972 Popov ..... B21D 3/06 72/79
3,940,963 A * 3/1976 Borodin ..... B21C 3/08 72/78
2014/0150512 A1 6/2014 Murphy

* cited by examiner

*Primary Examiner* — Teresa M Ekiert

(57) ABSTRACT

The present invention provides a pipe straightener, which consists of three roller wheel units and a restraining sleeve, wherein each of the roller wheel units is juxtaposed, and the roller wheel units enclose and are configured to form a long straight-formed passageway. The passageway is used to enable metal pipes to pass therethrough. The restraining sleeve encloses and covers each of the roller wheel units, thereby restraining each of the roller wheel units. Each of the roller wheel units is mainly structured from a wheel carrier and a plurality of roller wheels. One side of the wheel carrier is a first side, and the other side is a second side. The first side is adjacent to the passageway, and the second side is adjacent to the restraining sleeve.

5 Claims, 6 Drawing Sheets

PIPE STRAIGHTENER

BACKGROUND OF THE INVENTION

(a) Field of the Invention

The present invention relates to a hand tool that has special application with metal pipes, and more specifically to a pipe straightener, wherein the described pipe straightener is used to straighten metal pipes into a straight form or close to a straight form.

(b) Description of the Prior Art

Copper pipes are extensively used as ducts for fluids such as cooling/heating medium, water, gas, and the like. And because copper pipes are metal pipes that are easily bendable, copper pipes have been used in air conditioner systems, central heating systems, and gas supply systems in household and industrial piping installations. Copper pipes have also been used in brake systems and fuel oil systems of motor vehicles.

When manufacturing various types of metal pipes, including copper pipes, because the length of the metal pipes frequently reaches several meters, thus, the metal pipes are generally packaged in a coiled form, which provides added convenience for transportation and storage. Because the copper pipes are easily bent, installation workers generally bend the copper pipes with their hands when installing the copper pipes, attempting to straighten the wound round copper pipes. However, it is difficult to straighten the copper pipes by merely bending the copper pipes by hand.

USPTO Publication No. US 2014/0150512A1 discloses a pipe straightening apparatus, comprising four positioning members and a plurality of roller wheels, wherein the positioning members assume a circular configuration, and the center of the circular configuration forms a passageway enabling a copper pipe to pass therethrough. Four of the roller wheels are disposed between two of the adjacent positioning members, and each of the roller wheels is center pivoted on a wheel shaft. The two ends of each of the wheel shafts are respectively connected to the adjacent positioning members, and each of the wheel shafts is used to mutually join and fixedly position the adjacent positioning members. In addition, each of the roller wheels is arranged on the perimeter of the passageway to form four roller wheel groups. Each of the roller wheel groups is respectively assembled from the four roller wheels to assume a linear arrangement. When a copper pipe passes through the passageway, each of the roller wheel groups respectively abuts against different directional outer sides of the copper pipe, thereby straightening the copper pipe and causing the copper pipe to assume a straight form or close to a straight form.

Because each of the roller wheel groups respectively positioned on the perimeter of the passageway abuts against the different directional outer sides of the copper pipe passing therethrough. Thus, the roller wheels on the same roller wheel group assume a linear arrangement. And if any one of the roller wheels in the roller wheel group fails to be accurately positioned, then it affects the reliability of straightening when the copper pipe passes through the passageway. For example, if the roller wheels are deflected in a direction toward being closer to the center of the passageway, there is the possibility of some degree of hindrance occurring on the copper pipe passing through the passageway; or if the roller wheels are deflected in a direction away from the center of the passageway, there is also the possibility of affecting the reliability of straightening the copper pipe.

However, the two ends of each of the wheel shafts, on which the respective roller wheel is pivoted, is connected to one of the positioning members and the positioning member adjacent thereto, with each of the wheel shafts being used to join and fixedly position the positioning members. Accordingly, the space between each of the roller wheels comprising the roller wheel unit makes it difficult for the roller wheels to accurately assume a linear arrangement positioning configuration.

SUMMARY OF THE INVENTION

The main object of the present invention lies in providing a pipe straightener, wherein the described pipe straightener is used to straighten metal pipes into a straight form or close to a straight form.

To achieve the object of the present invention, the present invention relates a pipe straightener comprising three roller wheel units and a restraining sleeve, wherein each of the roller wheel units is juxtaposed, and the roller wheel units enclose and are conFIG.d to form a long straight-formed passageway, the passageway is used to enable metal pipes to pass therethrough; the restraining sleeve encloses and covers each of the roller wheel units, thereby restraining each of the roller wheel units; each of the roller units primarily comprises a wheel carrier and a plurality of roller wheels, one side of the wheel carrier is a first side, and the other side is a second side, the first side is adjacent to the passageway, and the second side is adjacent to the restraining sleeve, each of the roller wheels is respectively pivotal disposed on the first side, and the roller wheels are adjacent to the passageway.

Preferably, two connecting plates protrude from the first side of each of the wheel carriers, each of the connecting plates are mutually parallel, each of the roller wheels is respectively installed between the connecting plates, each of the roller wheels is respectively centrally pivoted on a shaft, and each of the roller wheels respectively rotates on the shaft as a center of rotation, the two ends of the shaft are respectively connected to the connecting plates.

Preferably, the restraining sleeve is a long tubular body, and each of the roller wheel units is disposed inside the restraining sleeve along the longitudinal direction thereof.

Preferably, the restraining sleeve inwardly forms a plurality of limiting portions, and each of the limiting portions is formed between each of the roller wheel units, thereby laterally limiting each of the roller wheel units.

Preferably, the one end of the restraining sleeve is provided with a first cap, and the other end of the restraining sleeve is provided with a second cap, the first cap and the second cap respectively restrain each of the roller wheel units, a through hole respectively penetrates the first cap and the second cap, and the through holes respectively correspond with the two ends of a passageway. thereby enabling metal pipes to pass through each of the through holes and enter/exit the passageway.

Preferably, the first cap and the second cap are respectively screw connected to the restraining sleeve.

Preferably, a plurality of bolts are used to bolt into the restraining sleeve from a side direction, and each of the bolts locks and joins each of the roller wheel units to the restraining sleeve.

Preferably, the restraining sleeve is a ring-shaped body.

The pipe straightener uses roller wheel units, and each of the roller wheel units uses a wheel carrier to fixedly position roller wheels, enabling the positioning of each of the roller wheels to be easily adjusted when installed on the wheel carrier. Moreover, a linear arrangement positioning configuration is easily and accurately assumed between each of the roller wheels of the wheel carriers.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
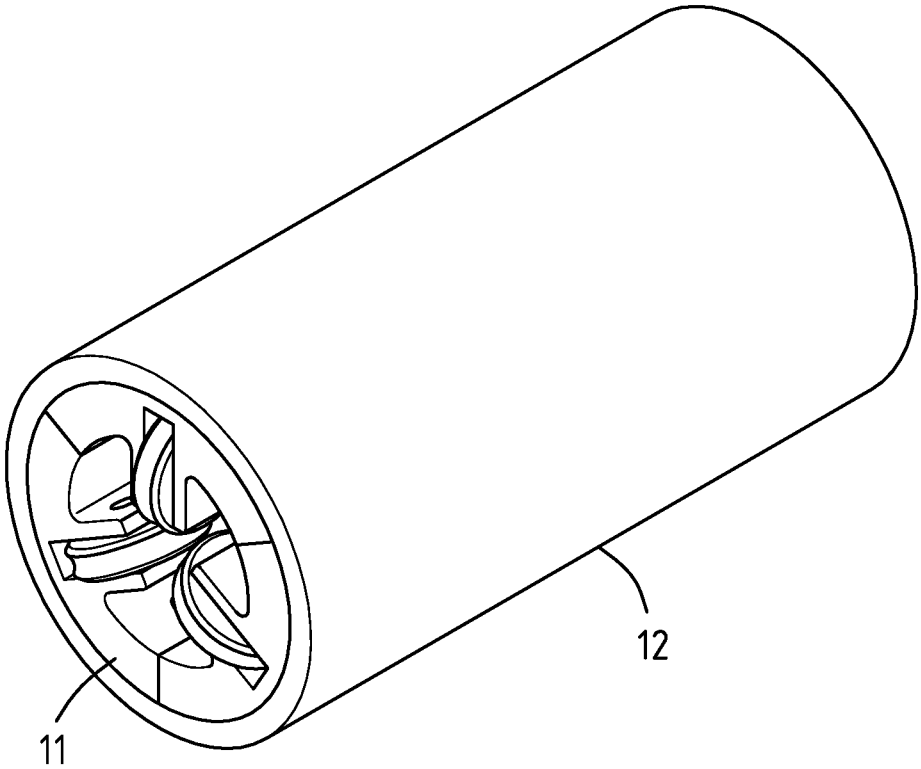
FIG. 1 is an elevational view of a first embodiment of the present invention.
Figure 2:
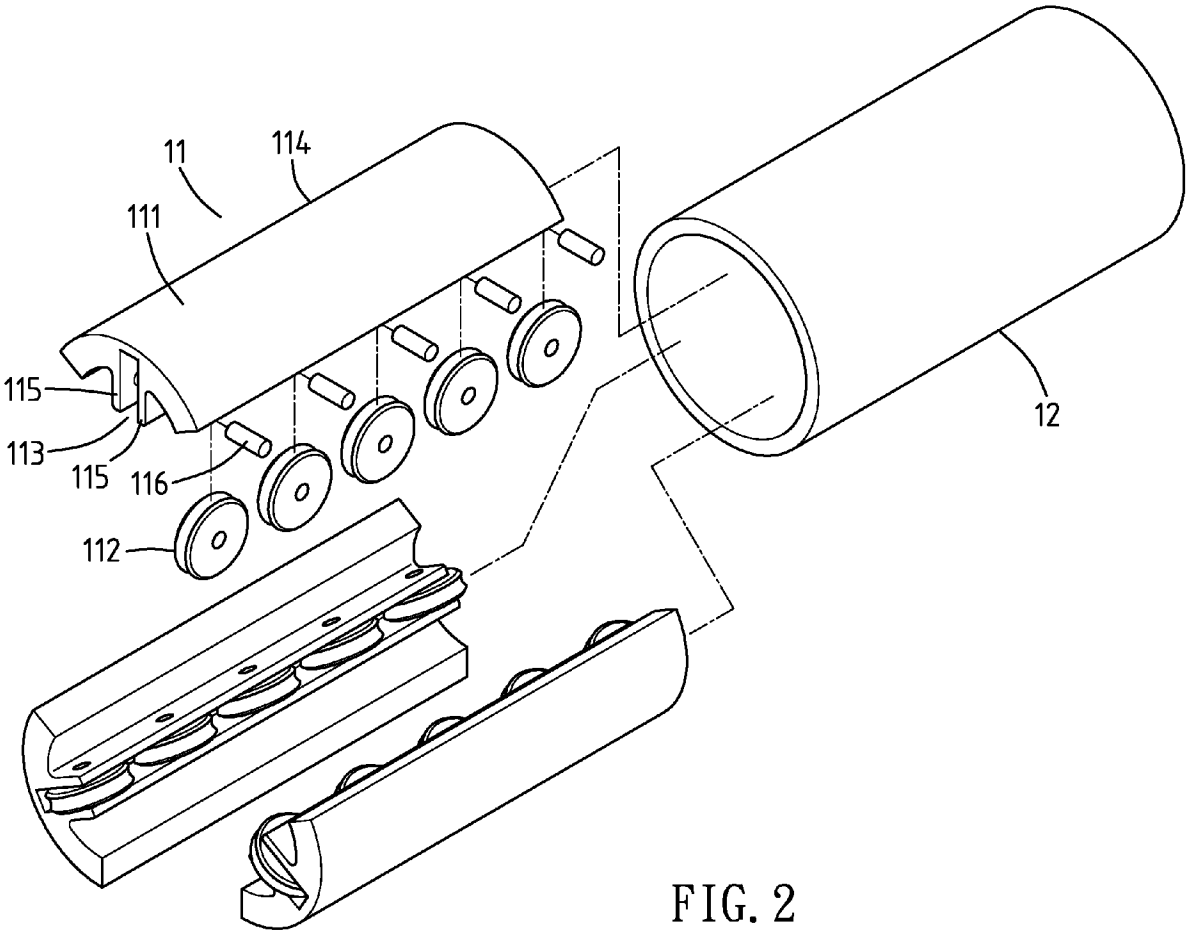
FIG. 2 is an exploded elevational view of the first embodiment of the present invention.
Figure 3:
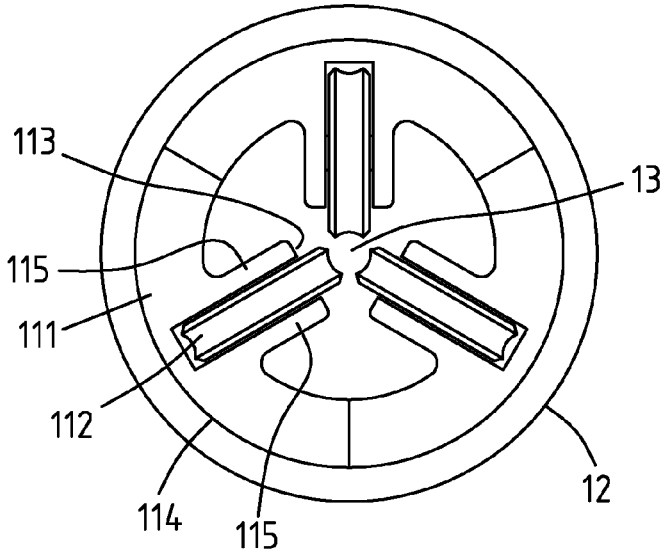
FIG. 3 is a front view of the first embodiment of the present invention.

Referring to FIGS. 1 to 3, which show a first embodiment of the present invention, comprising three roller wheel units (11) and a restraining sleeve (12), wherein each of the roller wheel units (11) is juxtaposed; moreover, the roller wheel units (11) enclose and are configured to form a long straight-formed passageway (13). The passageway (13) is used to enable a metal pipe (not shown in the drawings) to pass therethrough. The restraining sleeve (12) encloses and covers each of the roller wheel units (11), thereby restraining each of the roller wheel units (11).

The restraining sleeve (12) is a long tubular body, and each of the roller wheel units (11) is respectively disposed inside the restraining sleeve (12) along the longitudinal direction thereof.

Each of the roller wheel units (11) primarily comprises a wheel carrier (111) and a plurality of roller wheels (112), wherein one side of the wheel carrier (111) is a first side (113), and the other side is a second side (114). The first side (113) is adjacent to the passageway (13), and the second side (114) is adjacent to the restraining sleeve (12). Each of the roller wheels (112) is pivot mounted on the first side (113), and the roller wheels (112) are adjacent to the passageway (13), thereby enabling each of the roller wheels (112) to guide a metal pipe to pass through the passageway (13) by abutting against the outer side of the metal pipe, causing the metal pipe to form a straight form or close to a straight form.

Two connecting plates (115) protrude from one side of the first side (113) of the wheel carrier (111); the connecting plates (115) are mutually parallel. Each of the roller wheels (112) is installed between the connecting plates (115), and each of the roller wheels (112) is respectively centrally pivoted on a shaft (116). Moreover, each of the roller wheels (112) respectively rotates on the shaft (116) as a center of rotation, and the two ends of the shaft (116) are respectively connected to the connecting plates (115). The shafts (116) can be chosen to be bolts as an embodiment thereof.

When the first embodiment is used to straighten a metal pipe, the metal pipe enters the passageway (13) from one end thereof, and exits the passageway (13) from the other end of the passageway (13). When a metal pipe passes through the passageway (13), each of the roller wheels (112) of each of the roller wheel units (11) respectively abuts against the outer side of the metal pipe, causing different directional acting forces to act on the metal pipe, and causing the metal pipe to form a straight form or close to a straight form, thereby straightening the metal pipe.

Because each of the roller wheel units (11) uses the wheel carrier (111) to fixedly position each of the roller wheels (112), thus, the positioning of each of the roller wheels (112) can be easily adjusted when installed on the wheel carrier (111). Moreover, a linear arrangement positioning configuration is easily and accurately assumed between each of the roller wheels (112) configured on the wheel carriers (111).

Figure 4:
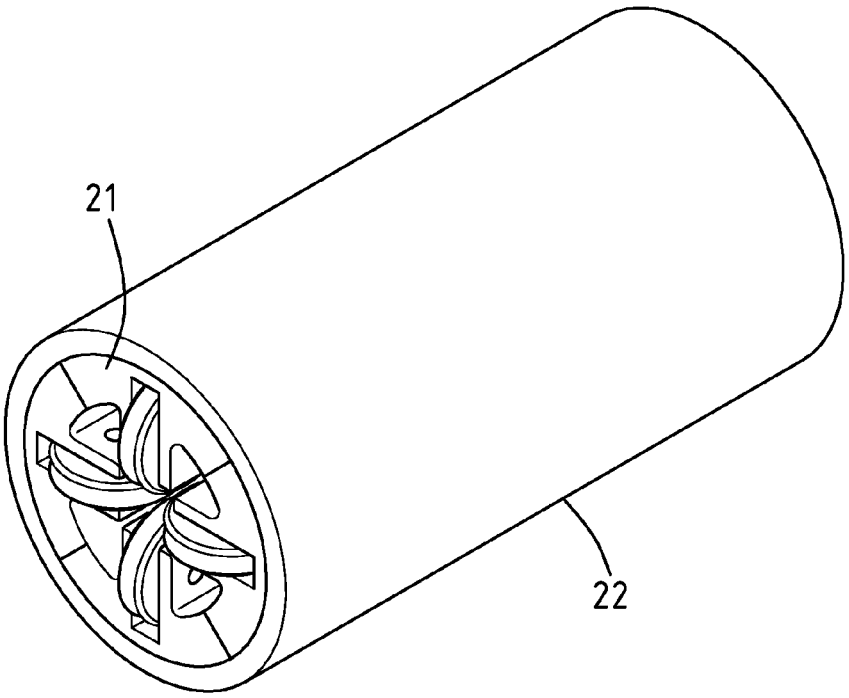
FIG. 4 is an elevational view of a second embodiment of the present invention.

A second embodiment of the present invention is obtained from a variation in the first embodiment. The second embodiment has the same structure as the first embodiment, and thus the description thereof is not repeated herein. Referring to FIG. 4, which shows the second embodiment comprising four roller wheel units (21) and a restraining sleeve (22), wherein each of the roller wheel units (21) is juxtaposed; moreover, the roller wheel units (21) enclose and are configured to form a long straight-formed passageway (not shown in the drawings). The passageway is used to enable a metal pipe (not shown in the drawings) to pass therethrough, and the restraining sleeve (22) encloses and covers each of the roller wheel units (21), thereby restraining each of the roller wheel units (21).

The major difference between the second embodiment and the first embodiment lies in the number of roller wheel units, wherein the present invention can further vary the number of roller wheel units to five or six or more than six. Choosing and configuring the number of roller wheel units can be easily inferred based on the description in the specification of the present invention.

Figure 5:
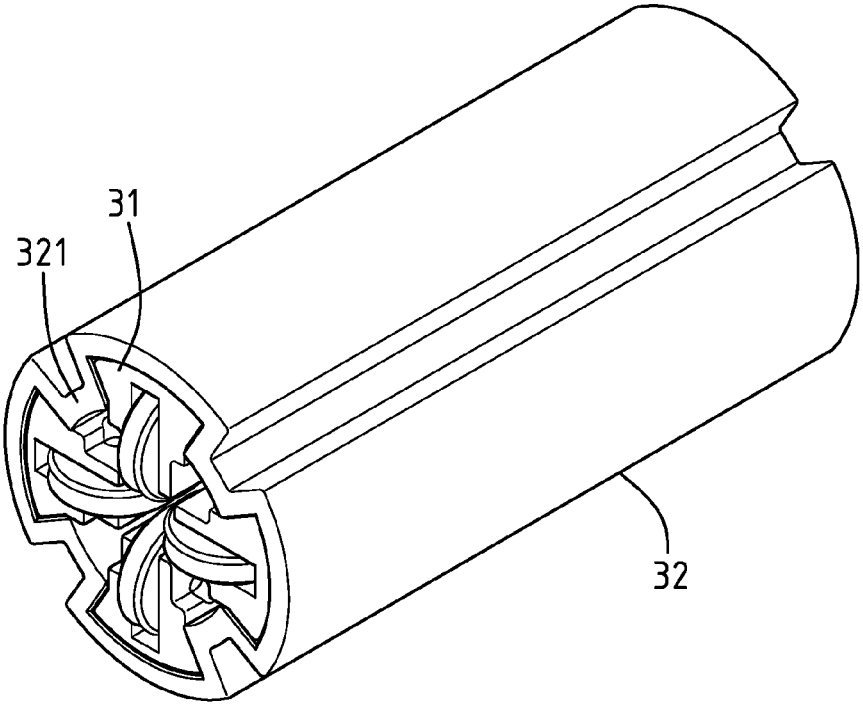
FIG. 5 is an elevational view of a third embodiment of the present invention.
Figure 6:
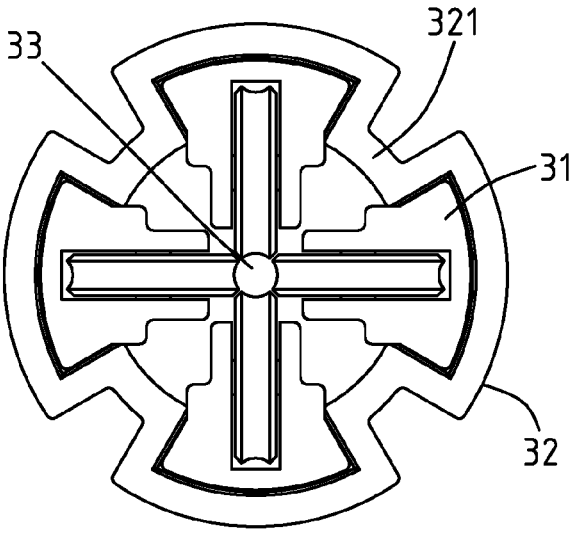
FIG. 6 is a front view of the third embodiment of the present invention.

A third embodiment of the present invention is obtained from a variation in the first embodiment. The third embodiment has the same structure as the first embodiment, and thus the description thereof is not repeated herein. Referring to FIG. 5 and FIG. 6, which show the third embodiment comprising four roller wheel units (31) and a restraining sleeve (32), wherein each of the roller wheel units (31) is juxtaposed; moreover, the wheel roller units (31) enclose and are configured to form a long straight-formed passageway (33). The passageway (33) is used to enable a metal pipe (not shown in the drawings) to pass therethrough. The restraining sleeve (32) encloses and covers each of the roller wheel units (31), thereby restraining each of the roller wheel units (31).

The restraining sleeve (32) inwardly forms a plurality of limiting portions (321); moreover, each of the limiting portions (321) is formed between each of the roller wheel units (31), thereby laterally limiting each of the roller wheel units (31).

Figure 7:
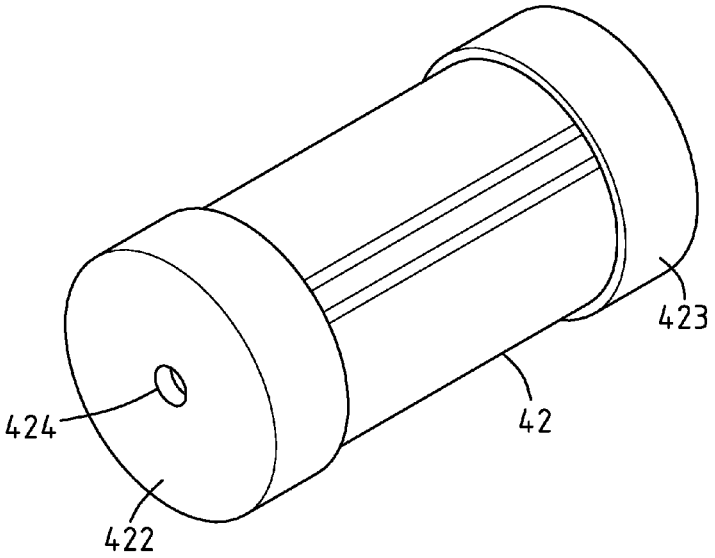
FIG. 7 is an elevational view of a fourth embodiment of the present invention.
Figure 8:
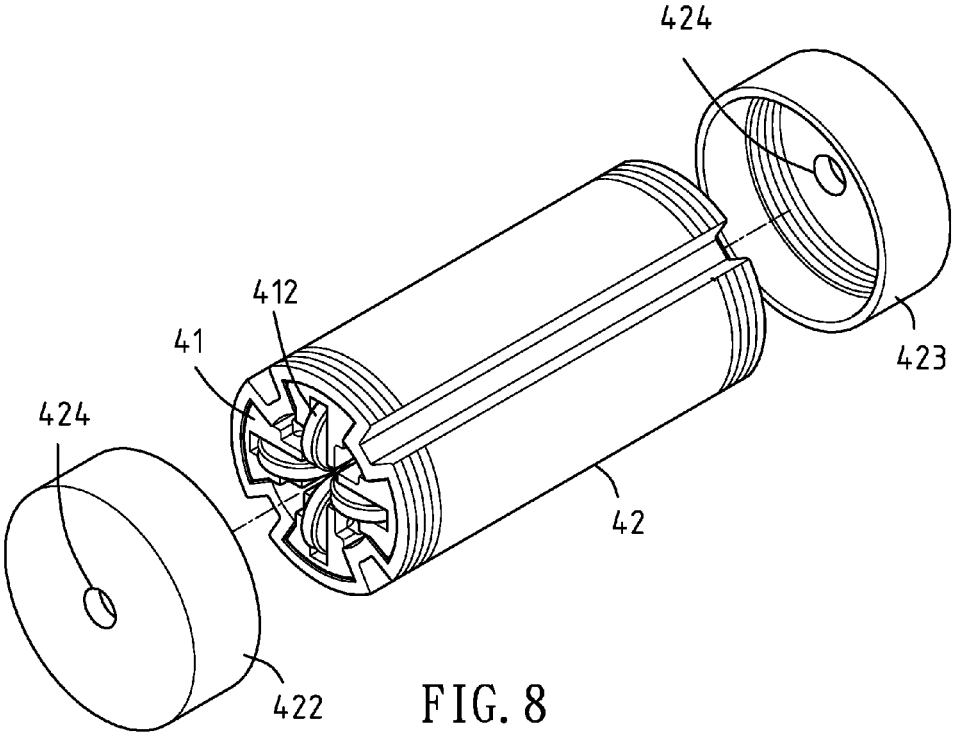
FIG. 8 is an exploded elevational view of the fourth embodiment of the present invention.

A fourth embodiment of the present invention is obtained from a variation in the first embodiment. The fourth embodiment has the same structure as the first embodiment, and thus the description thereof is not repeated herein. Referring to FIG. 7 and FIG. 8, which show the fourth embodiment comprising four roller wheel units (41) and a restraining sleeve (42), wherein each of the roller wheel units (41) is juxtaposed; moreover, the roller wheel units (41) enclose and are configured to form a long straight-formed passageway (not shown in the drawings). The passageway is used to enable a metal pipe (not shown in the drawings) to pass therethrough. The restraining sleeve (42) encloses and covers each of the roller wheel units (41), thereby restraining each of the roller wheel units (41).

One end of the restraining sleeve (42) is provided with a first cap (422), and the other end is provided with a second cap (423). The first cap (422) and the second cap (423) are respectively screw connected to the restraining sleeve (42), thereby enabling the first cap (422) and the second cap (423) to respectively restrain and prevent each of the roller wheel units (41) from sliding out of the restraining sleeve (42). The first cap (422) and the second cap (423) are respectively provided with a through hole (424) that penetrates therethrough. Each of the through holes (424) respectively corresponds with the two ends of the passageway, thereby enabling a metal pipe to pass through each of the through holes (424) and enter/exit the passageway.

The fourth embodiment of the present invention uses the first cap (422) and the second cap (423) respectively installed on the two ends of the restraining sleeve (42) to provide not only the function to prevent each of the roller wheel units (41) from sliding out of the restraining sleeve (42), but also make it difficult for external foreign bodies to enter the interior of the restraining sleeve (42), which would otherwise affect rotation of the roller wheels (412) of each of the roller wheel units (41).

Figure 9:
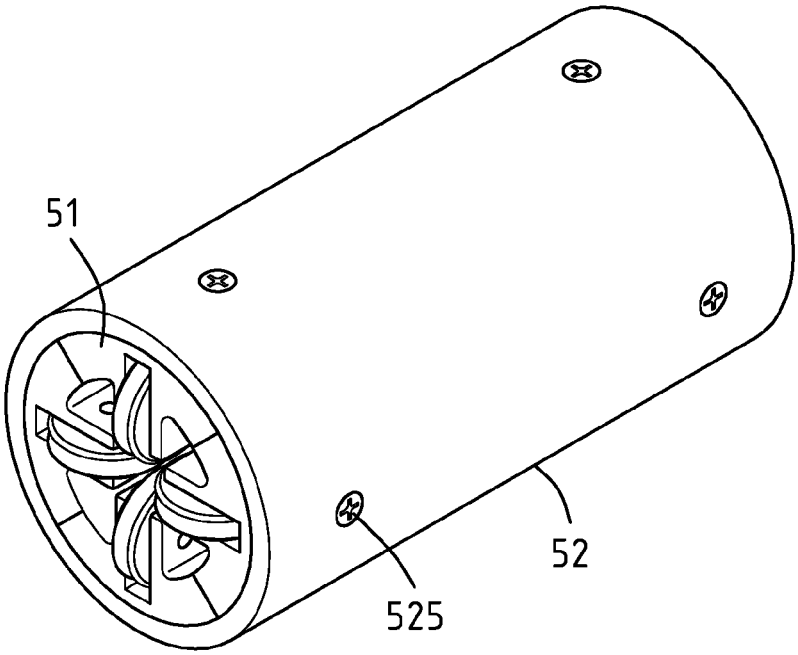
FIG. 9 is an elevational view of a fifth embodiment of the present invention.

A fifth embodiment of the present invention is obtained from a variation in the first embodiment. The fifth embodiment has the same structure as the first embodiment, and thus the description thereof is not repeated herein. Referring to FIG. 9, which shows the fifth embodiment comprising four roller wheel units (51) and a restraining sleeve (52), wherein each of the roller wheel units (51) is juxtaposed; moreover, the roller wheel units (51) enclose and are configured to form a long straight-formed passageway (not shown in the drawings). The passageway is used to enable a metal pipe (not shown in the drawings) to pass therethrough. The restraining sleeve (52) encloses and covers each of the roller wheel units (51), thereby restraining each of the roller wheel units (51).

A plurality of bolts (525) are used to bolt into the restraining sleeve (52) from a side direction, wherein each of the bolts (525) respectively locks and joins each of the roller wheel units (51) to the restraining sleeve (52); thereby increasing the restraining reliability of the restraining sleeve (52) on each of the roller wheel units (51).

Figure 10:
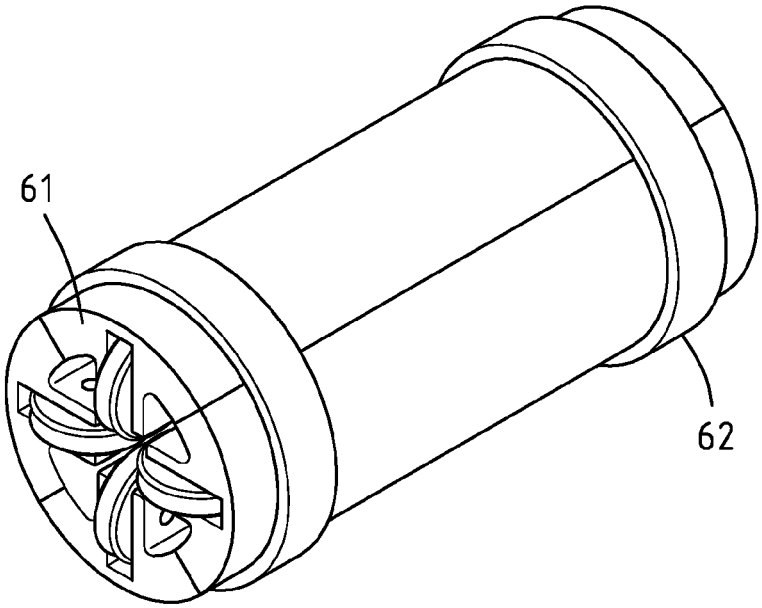
FIG. 10 is an elevational view of a sixth embodiment of the present invention.

A sixth embodiment of the present invention is obtained from a variation in the first embodiment. The sixth embodiment has the same structure as the first embodiment, and thus the description thereof is not repeated herein. Referring to FIG. 10, which shows the sixth embodiment comprising four roller wheel units (61) and two restraining sleeves (62), wherein each of the roller wheel units (61) is juxtaposed; moreover, the roller wheel units (61) enclose and are configured to form a long straight-formed passageway (not shown in the drawings). The passageway is used to enable a metal pipe (not shown in the drawings) to pass therethrough. The restraining sleeve (62) encloses and covers each of the roller wheel units (61), thereby restraining each of the roller wheel units (61).

The restraining sleeves (62) are ring-shaped bodies, and the restraining sleeves (62) are constructed from metallic material or flexible rubber material.

The sixth embodiment of the present invention can further change the number of the restraining sleeves (62) to one or more than two. And choosing and configuring the number of the restraining sleeves (62) can be easily inferred based on the description in the specification of the present invention Changing the dimensions of the wheel carrier or roller wheels of the roller wheel units enclosed by the restraining sleeve enables the pipe straightener of the present invention to have application in straightening metal pipes with different external diameters.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A pipe straightener, comprising three roller wheel units and a restraining sleeve, wherein each of the roller wheel units is juxtaposed, and the roller wheel units enclose and are configured to form a long straight-formed passageway, the passageway is used to enable metal pipes to pass therethrough; the restraining sleeve encloses and covers each of the roller wheel units, thereby restraining each of the roller wheel units;

each of the roller units primarily comprises a wheel carrier and a plurality of roller wheels, one side of the wheel carrier is a first side, and the other side is a second side, the first side is adjacent to the passageway, and the second side is adjacent to the restraining sleeve, each of the roller wheels is respectively pivotal disposed on the first side, and the roller wheels are adjacent to the passageway;

wherein the restraining sleeve is a long tubular body, and each of the roller wheel units is disposed inside the restraining sleeve along the longitudinal direction thereof;

wherein the restraining sleeve inwardly forms a plurality of limiting portions, and each of the limiting portions is formed between each of the roller wheel units, thereby laterally limiting each of the roller wheel units.

2. The pipe straightener according to claim 1, wherein two connecting plates protrude from the first side of each of the wheel carriers, each of the connecting plates are mutually parallel, each of the roller wheels is respectively installed between the connecting plates, each of the roller wheels is respectively centrally pivoted on a shaft, and each of the roller wheels respectively rotates on the shaft as a center of rotation, the two ends of the shaft are respectively connected to the connecting plates.

3. The pipe straightener according to claim 1, wherein one end of the restraining sleeve is provided with a first cap, and the other end of the restraining sleeve is provided with a second cap, the first cap and the second cap respectively restrain each of the roller wheel units, a through hole respectively penetrates the first cap and the second cap, and the through holes respectively correspond with the two ends of a passageway thereby enabling metal pipes to pass through each of the through holes and enter/exit the passageway.

4. The pipe straightener according to claim 3, wherein the first cap and the second cap are respectively screw connected to the restraining sleeve.

5. The pipe straightener according to claim 1, wherein a plurality of bolts are used to bolt into the restraining sleeve from a side direction, and each of the bolts locks and joins each of the roller wheel units to the restraining sleeve.

* * * * *